US005263533A

United States Patent [19]

Druschitz et al.

[11] Patent Number: 5,263,533

[45] Date of Patent: Nov. 23, 1993

[54] MOLD FOR PRODUCING THIN WALL CASTINGS BY GRAVITY POURING

[75] Inventors: Alan P. Druschitz, Troy; Edward F. Ryntz, Jr., Warren; Robert M. Ramage, Troy; Alexander J. Toth, III, Fraser, all of Mich.

[73] Assignee: General Motors Corporation, Detroit, Mich.

[21] Appl. No.: 35,828

[22] Filed: Mar. 23, 1993

Related U.S. Application Data

[63] Continuation-in-part of Ser. No. 883,018, May 14, 1992, abandoned.

[51] Int. Cl.[5] ..... B22C 9/02; B22C 9/08

[52] U.S. Cl. ..... 164/363; 164/349

[58] Field of Search ..... 164/363, 349, 133, 135

[56] References Cited

U.S. PATENT DOCUMENTS

| | | | |
|---|---|---|---|
| 451,575 | 5/1891 | Richards | 164/133 |
| 451,900 | 5/1891 | Richards | 164/133 |
| 2,806,268 | 9/1957 | Bilter . | |
| 3,926,245 | 12/1975 | Kanaby | 164/53 |
| 4,989,665 | 2/1991 | Yamagiwa et al. | 164/363 |

FOREIGN PATENT DOCUMENTS

| | | | |
|---|---|---|---|
| 748898 | 7/1933 | France | 164/363 |
| 759452 | 2/1934 | France | 164/135 |
| 816671 | 3/1981 | U.S.S.R. | 164/363 |
| 1113206 | 9/1984 | U.S.S.R. | 164/133 |
| 1306646 | 4/1987 | U.S.S.R. | 164/133 |
| 649855 | 2/1951 | United Kingdom | 164/363 |

OTHER PUBLICATIONS

*Metals Handbook*, 8th Edition, 1970, vol. 5, "Forging and Casting", pp. 155, 167.

*Metals Handbook*, 9th Edition, 1988, vol. 15, "Casting", pp. 38, 45, 590–594.

*Primary Examiner*—J. Reed Batten, Jr.

*Attorney, Agent, or Firm*—George A. Grove

[57] ABSTRACT

The mold formed of resin-bonded sand includes a vertical sprue in fluid flow communication with a horizontal chamber reservoir underlying the mold cavity defining the thin wall structure. The thin wall cavity portion is positioned about a common horizontal level above the reservoir. Vertical runners feed the metal from the horizontal reservoir up into the cavity. The number and location of these runners are such as to fill the cavity from several points of entry with uniform temperature metal before any solidification occurs.

3 Claims, 2 Drawing Sheets

MOLD FOR PRODUCING THIN WALL CASTINGS BY GRAVITY POURING

This application is a continuation-in-part of U.S. Ser. No. 07/883,018 filed May 14, 1992 and now abandoned.

This invention pertains to the production of thin wall metal castings and more specifically to a mold design practice for producing such castings by gravity pouring.

BACKGROUND OF THE INVENTION

There is a need for a process for reliably producing high quality, gravity cast, thin wall metal castings. This need is especially acute in the automotive industry where efforts to increase fuel economy require that attempts be made to reduce the mass of the automobile. Significant reductions in the mass of cast metal components such as automotive engine blocks, exhaust manifolds and the like could be obtained if dimensionally accurate, defect-free castings could be reliably and efficiently produced in high volume.

When we refer to thin wall castings, we mean castings having substantial wall surfaces as small as one to three millimeters in thickness. Frequently, the thin wall portions of such castings have a rounded cross-section (i.e., circular, elliptical, octagonal, etc.) and are no more than about 160 mm in diameter. Examples of such castings are tubes, engine exhaust manifolds, cylinder heads, engine blocks, pistons and the like.

The difficulty with producing thin wall castings arises from the need for cast hot molten metal to flow through extensive, relatively small cavity passages in an unheated mold. Any freezing of the metal before the cavity is completely filled will yield castings with nonuniform walls or castings with holes or other defects. There are existing commercial processes for the casting of thin wall iron and aluminum castings that provide some inducement to the flow of the cast metal to promote complete mold fill before solidification. In these practices, a suitably designed resin-bonded sand mold is prepared that suitably defines the thin wall portions of the casting. The mold is filled from the bottom utilizing a pump or a pressure differential to cause the molten metal to flow rapidly into the mold cavity to fill it before solidification occurs. In these practices, a continuous metal flow link must be made between a reservoir of molten metal and the mold. In one such practice, the reservoir is pressurized to cause the flow of metal toward the mold. In another practice, the mold is subjected to a vacuum to assist the flow of cast metal into the mold cavity. In other practices, both a vacuum in the mold and pressure on the reservoir are employed.

In each of these cases, it is necessary for the metal at the ingates to the casting cavity in the mold to freeze off before the mold can be removed from the reservoir from which the metal is contained. This means that appreciable solidification must occur before the next mold can be filled from the molten metal reservoir. This slows a casting line, decreasing production rates.

Such prior art practices have an additional disadvantage. They require special equipment to provide for pressurization of the molten metal reservoir or for containment of the mold in a vacuum chamber or both. In some practices, an electromagnetic pump is employed. Both of these metal flow inducing mechanisms represent a substantial capital investment as well as process complexity which add to the cost of castings produced.

It is an object of the present invention to provide a resin-bonded sand mold design that will accommodate the gravity pouring of molten metal so that thin wall, defect-free castings can be reliably, accurately and efficiently produced.

It is a further object of the present invention to provide a gravity-castable mold design that permits all portions of the thin wall mold cavity to be filled with hot metal at substantially the same temperature and the same time, thereby rapidly filling the whole cavity and minimizing the chances for premature metal freezing and faulty castings.

It is a still further object of the present invention to provide a resin-bonded sand mold that is specially adapted for the casting of thin walled ducts for fluid flow such as, for example, tubes, engine exhaust manifolds, cylinder heads and engine cylinder blocks.

BRIEF SUMMARY OF THE INVENTION

In accordance with a preferred embodiment of our invention, these and other objects and advantages are accomplished as follows. The practice of our invention utilizes high strength dimensionally accurate, resin-bonded sand molds made from a suitable foundry sand such as AFS #85 silica sand or lake sand. The sand is suitably bonded, for example, with about 1.5 weight percent of a no-bake, oil-urethane resin binder system. An example of a suitable binder system is the Lino-Cure system produced by Ashland Chemicals.

Our invention is suitable for use in the casting of thin wall tubes, hollow ducts or similar, relatively small diameter, rounded or circumscribed hollow shapes, and components containing such features. Our invention is particularly suitable where such features can be cast in a substantially common horizontal plane. In a common and preferred embodiment, we employ cope and drag mold portions where the hollow body axes are generally aligned with the parting plane of the cope and drag portions of the mold. Thus, in this embodiment, the mold arrangement will comprise accurately dimensioned duct wall cavities formed in the cope and drag portions of the mold with a suitable core member disposed at the parting plane so as to define the duct walls. In accordance with our invention, duct walls may be as small as one to three millimeters in thickness and up to about 160 mm across the opening of the duct.

The cope mold is placed on the drag mold, and the drag mold is placed on a resin-bonded sand mold slab that defines an ample molten metal reservoir directly underlying the tube or duct cavity defining portions of the mold. We employ a vertical sprue mold member rising above the cope portion of the mold to supply molten metal to our mold and provide a metallostatic head of metal. The sprue member, cope, drag and slab each have a connected cylindrical passage down through the cope and drag, laterally offset from the tubular cavities, to conduct cast molten metal past the casting cavity to the reservoir in the slab. A plurality of vertical cylindrical runners is provided in the drag and lower portions of the cope members of the mold rising from the reservoir in the slab member up to the casting cavity or just offset from the cavity and connected thereto by horizontal ingates. The number and location of these runners and ingates are determined by the effective filling distance of the molten metal in the thin wall portion of the cavity(ies).

Thus, in the practice of our invention, hot molten metal is poured into a suitable pouring basin in the sprue and through the mold members so that it flows into and fills the reservoir in the slab underlying the drag portion before any metal can flow up toward the casting cavity. The reservoir underlies the critical thin wall portions of the mold cavity and is shaped to minimize heat loss from the metal and to promote mixing for uniform metal temperature. Once the reservoir underlying the mold cavity is completely filled, molten metal then rises straight up substantially simultaneously in the plurality of vertical runners up to the mold cavity, filling it substantially uniformly with hot molten metal of substantially uniform temperature. In this way, molten metal quickly and uniformly fills the mold cavity so that the thin wall portions of the mold are completely filled before any metal solidifies.

Our practice is based on a mold design that requires the cast metal to first fill a reservoir underlying the thin wall portions of the casting cavity. When the reservoir is full, the metal rises simultaneously in a plurality of vertical runners to fill the thin portions of the cavity quickly from several points of entry. The spacing of these points of entry, known as ingates, should be no greater than a determinable effective filling distance within the cavity which is a function of metallostatic head and pouring temperature (superheat) of the cast metal and the wall thickness of the cavity. This distance may be, e.g., in the range of 25 to 450 mm. We have successfully used this practice to cast ferrous metal alloy thin walled tubes and thin wall exhaust manifolds ranging in wall thickness sizes from one to three millimeters.

Apart from being able to reliably cast dimensionally accurate thin wall castings by our mold design practice, it also offers the advantage of not requiring additional equipment to force the metal into the mold cavities. Furthermore, our atmospheric gravity pouring practice offers the important advantage of permitting the mold to be moved away from the pouring source of molten metal before any solidification has occurred.

Other objects and advantages of our invention will become more apparent from a detailed description thereof which follows. In this detailed description, reference will be had to the drawings in which:

DETAILED DESCRIPTION OF PREFERRED EMBODIMENTS

Figure 1:
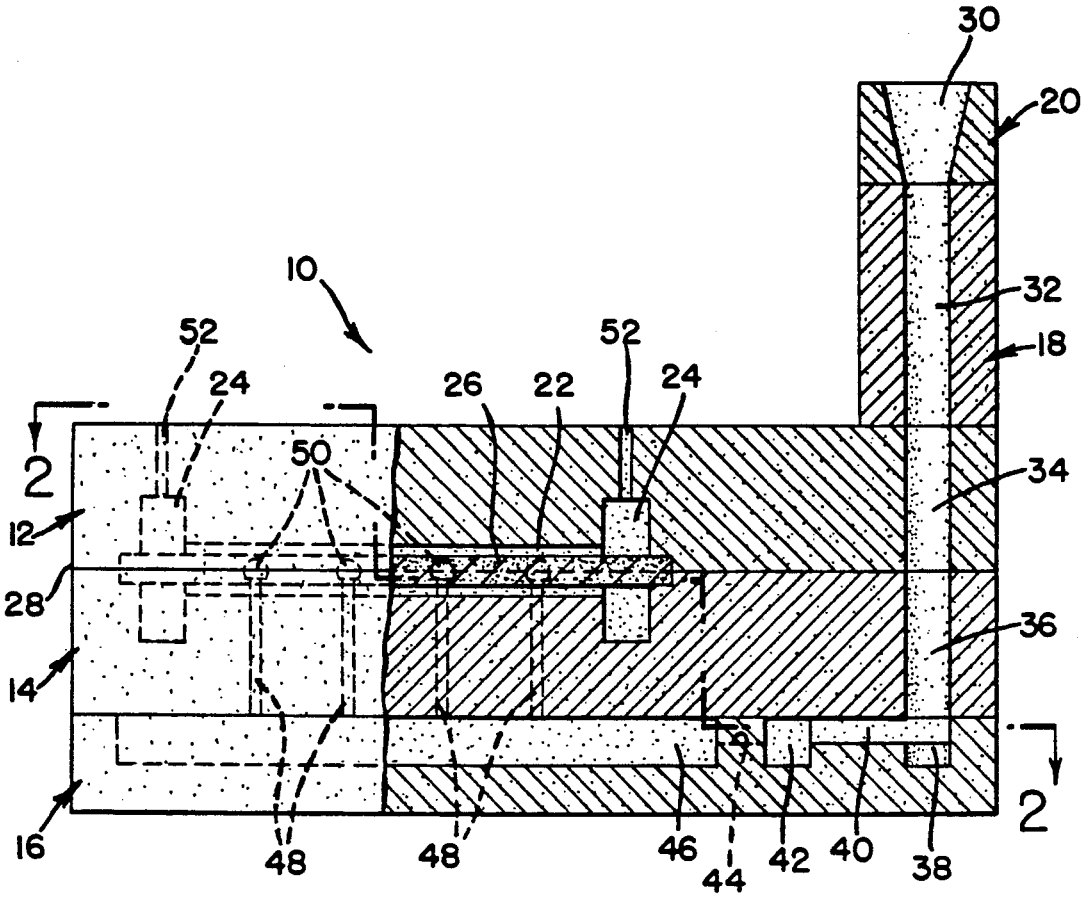
FIG. 1 is an elevational view, partly broken away and in section, of mold members suitable for the practice of our invention to produce thin walled tube castings.

The practice of our invention is applicable to the manufacture of gray iron, nodular iron, austenitic and ferritic stainless steel castings and plain carbon steels and alloy steels. The practice of our invention is also applicable to the practice of making aluminum castings and castings of other nonferrous metal. However, it will be appreciated that it is particularly applicable to making ferrous metal castings with thin walled tubular sections because the iron alloys are poured at high temperatures and can readily solidify prematurely in the relatively cold thin wall mold sections.

As stated above, we use a high quality foundry sand such as a silica sand of AFS #85 designation or a suitable lake sand. We require that the sand mold members be resin bonded sand so that they are durable and resist the erosion of rapidly flowing hot molten metal. Again, as indicated above, we prefer the use of a no-bake oil-urethane resin binder system such as that specified above.

In the following description of specific embodiments of our molds, we will provide specific dimensions for better illustration. The drawing figures are not to scale.

Figure 2:
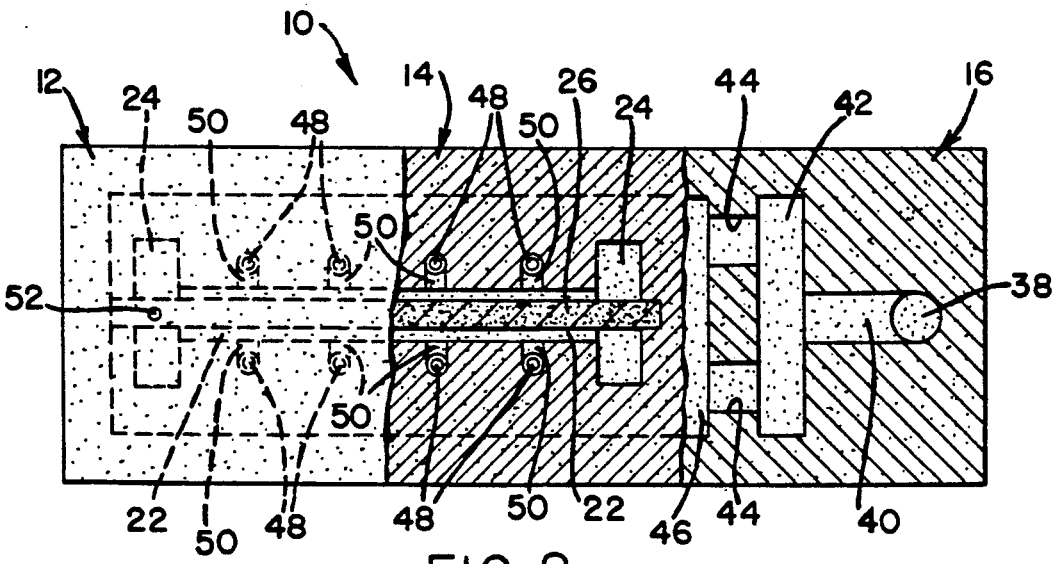
FIG. 2 is a plan view, partly in section, taken along lines 2—2 of FIG. 1.

As seen in FIGS. 1 and 2, our mold 10 comprises a cope portion 12, a drag 14, a slab 16 underlying drag 14, a pouring sprue 18, and a pouring funnel 20. Each of these mold pieces is made of resin-bonded sand.

The cope and drag mold portions cooperate to define therebetween a cavity 22 of a thin wall tube (31.75 mm I.D.) having flange portions 24 (69.85 mm O.D.×12.7 mm) at each end. In accordance with our practice, the thin wall tube (304.8 mm long between flanges) as defined by cavity 22 may be in the range of one to three millimeters in thickness. The internal surface of the tube is defined by core member 26, which is supported by and between the cope 12 and drag 14 molds. It is seen that the center line of the cylindrical core 26 lies at the horizontal parting surface 28 between the cope 12 and drag 14 portions of the mold.

In accordance with the practice of our invention, molten metal is poured into the opening 30 in the pouring funnel 20 and flows downwardly through the cylindrical opening 32 (38.1 mm diameter) in the pouring sprue 18, through cylindrical opening 34 in cope 12 and cylindrical opening 36 in drag 14 into the well 38 in slab 16. The height of sprue 18 is such that a minimum of 150 mm head of molten iron can be maintained above the top of vertical runners 48 and ingates 50. From well 38, the molten metal flows through runner portions 40, 42 and 44 into the large (406.4 mm long×152.4 mm wide×12.7 mm high) horizontal reservoir chamber 46. Only at such time as reservoir 46 is completely filled with the cast molten metal can the level then rise into vertical runners 48. In the arrangement shown in FIGS. 1 and 2, it is seen that there are eight such vertical runners 48 (6.35 mm diameter) that are of equal length (101.6 mm), four on each side of the tube cavity 22. The vertical runners are 50.8 mm from their nearest neighbor on the same side of the tube cavity 22. Thus, molten metal will simultaneously rise at substantially the same rate in each of the vertical runners 48, reaching the level of the horizontal ingates 50 of which there are eight, and thus into the tube cavity 22 and flange cavities 24. Once the critical thin wall cavity has been filled, molten metal can then rise out of the flange cavities 24 through riser/vents 52 (3.175 mm diameter). The small amount of metal flowing into and through these vents 52 quickly freezes and permits the higher level of metal in sprue 18 to keep liquid pressure on the metal in the cavity 22 as it solidifies.

Thus, it is seen that the vertical sprue for the incoming molten metal cooperates with the reservoir 46 to supply a suitable metallostatic head of gravity cast molten metal to uniformly and rapidly fill the critically thin wall casting cavity 22. Preferably the molten metal (here a nodular iron alloy) is cast at a temperature of at least 90° C. above the temperature for the cast alloy at which the first solidification occurs. The reservoir 46 is located immediately below the critical casting cavity and supplies molten metal substantially simultaneously and at approximately equal rates to several different locations in the critically thin cavity 22 as shown in FIGS. 1 and 2. These locations, or ingates, are established after determining the effective filling distance based on the superheat and at least a 150 mm metallostatic head of iron or the equivalent head for other alloys.

Figure 3:
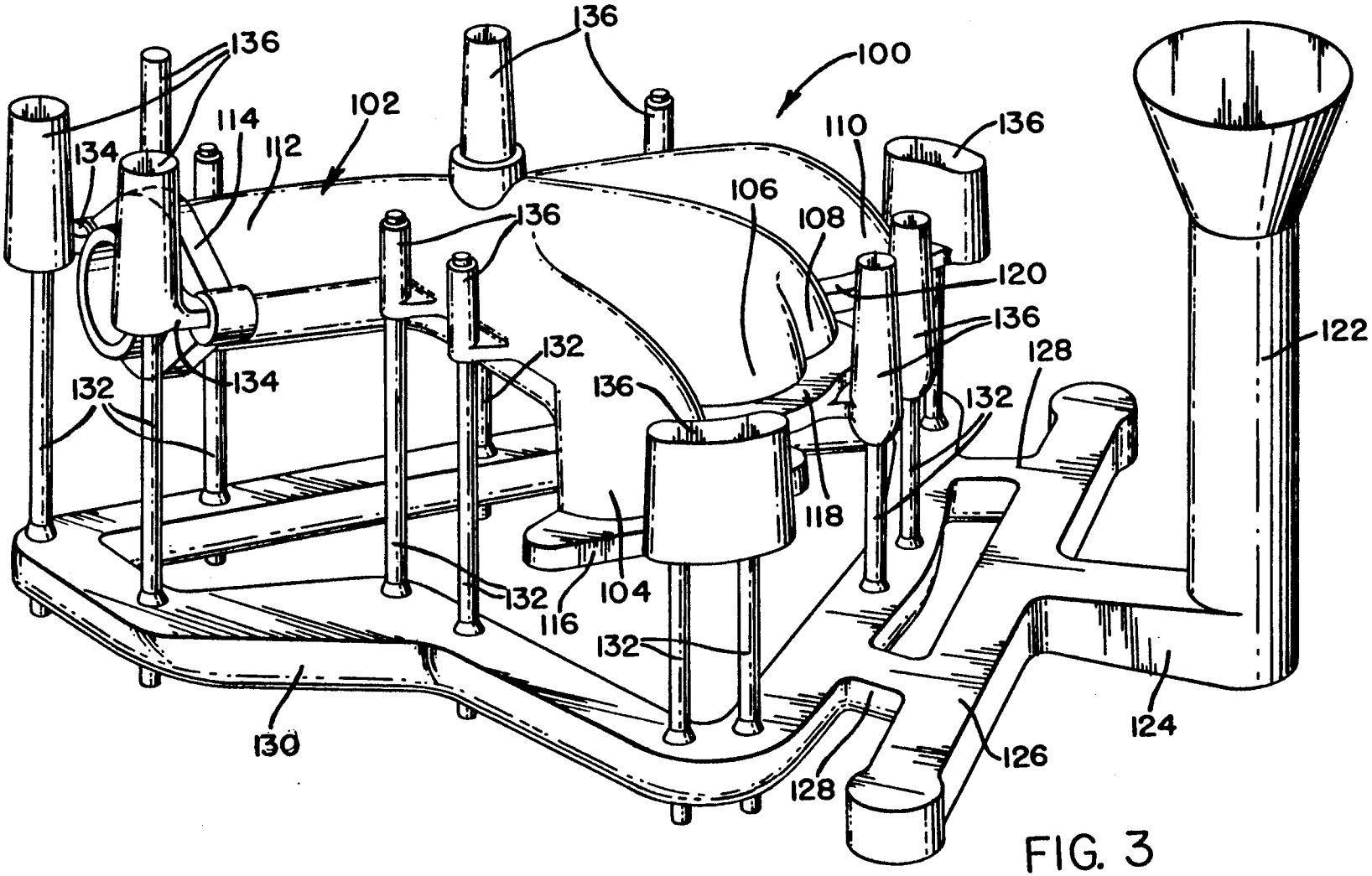
FIG. 3 is an illustration of an exhaust manifold casting for an automotive internal combustion engine depicting all of the solidified metal as the casting was poured.

FIG. 3 illustrates another embodiment in the practice of our invention. In this view, we illustrate a solidified casting wherein all of the cast metal remains before the non-product portion has been removed. This view of the full casting may better illustrate how the cast metal flowed into the mold which can be visualized in place about the casting.

Thus, illustrated in FIG. 3 is the total solidified metal casting 100 for an exhaust manifold piece 102 that comprises exhaust ducts 104, 106, 108 and 110 for a four cylinder internal combustion engine. The ducts merge into manifold exhaust duct 112 terminating in flange 114 for connection to an exhaust pipe. Flanges 116, 118 and 120 are adapted to connect the exhaust ducts to an engine cylinder head. As revealed in the total finished casting 100, the vertical sprue portion 122 (38.1 mm diameter in cylindrical portion) is the solidified metal that was left in the sprue portion of the mold (not shown) after the casting had completely solidified. Portions 124, 126 and 128 are horizontal runner portions of supplied metal to the horizontal reservoir portion 130 of the mold. The generally triangular reservoir 130 is about 25.4 mm wide×22.225 mm deep×1117.6 mm long (perimeter). Reservoir 130 is a channel-type reservoir underlying the periphery of the exhaust manifold casting 102 for supply of molten metal simultaneously to all regions of the casting. Also clearly shown in the finish casting 100 is the solidified metal that remained in a plurality of vertical risers or runners 132. Thirteen vertical runners 132 are employed. They are all 9.525 mm in diameter. Due to the downward curvature of ducts 104, 106 and 108, the runners 132 were not all the same length. The longest runners (104.775 mm) were adjacent flange 114 and the shortest (85.725 mm) adjacent duct 104. However, the number and deployment of the runners were suitable to successfully cast this complex shape thin wall body. Portions 134 of the casting are the metal that solidified in the horizontal ingates of the mold. The remainders of the casting indicated at 136 represent the metal that solidified in the closed riser portions of the mold.

It is seen that in the gravity pour casting of the exhaust manifold 102, molten metal was first poured through two equivalent runner 128 paths into a mold reservoir (casting portion 130) underlying the manifold mold cavity. The sprue portion of the casting 122 extended 254 mm above the level of the ingates 134. Molten metal of uniform temperature then flowed upwardly from the reservoir simultaneously in thirteen vertical mold runners (casting portions 132) to quickly and substantially uniformly fill the thin sections of the principal casting cavity. The spacing between the runners varied from 15.875 mm to 152.4 mm. In this way, the thin portions of the unheated mold were rapidly filled with molten metal before any premature solidification could occur to produce a defective casting. It is also seen that such vertical runners could be extended upwardly through their respective closed riser 136 to supply additional thin wall casting cavities of one or more identical castings located successively directly above a first cavity. Thus, each such additional cavity can be filled with metal from the same plurality of points of entry. Furthermore, once such a mold has been filled with molten metal, it can be removed from the pouring source so that another mold can be poured.

Utilizing casting molds like that described above in connection with FIGS. 1 through 3, we have cast exhaust manifolds from a nodular iron composition in which the wall thickness of the exhaust ducts was in the range of 2.7 to 3.2 millimeters. We have cast stainless steel exhaust manifolds having duct walls 2.6 to 3.2 millimeters in thickness. The cross sections of the ducts of the FIG. 3 casting were shaped like rounded corner rectangles and ranged in size from 30 mm×40 mm to 55 mm×60 mm. The length of the cast duct passages are often 300 to 600 mm. We have also cast a turbine inlet shroud of nodular iron. The shroud was shovel-shaped, had a wall thickness of 3 mm and other dimensions of 620 mm long×600 mm wide×200 mm high.

We have cast as many as three thin wall exhaust manifolds at one time by stacking mold sections vertically so that the manifold cavities were positioned in layers above the metal reservoir. Each cavity was fed by vertical sprue risers from the reservoir. We are able to do this on a repetitive and reliable basis. The same practice can be used to cast even thinner wall thicknesses. The exhaust manifolds are complex because the tubes are curved and the metal must flow in several directions in order to fill the mold cavities. In the case of straight tubes such as those depicted in FIGS. 1 and 2, we have cast tubes with walls one millimeter, two millimeters and three millimeters in thickness in the same casting. The internal diameter of the round tubes in each case was about 30 mm and the length about 300 mm.

We have described the practice of our invention using cope and drag molds with horizontal parting planes. Other mold arrangements utilizing other parting planes may be utilized. The essential feature of our practice is the positioning of the thin wall cavity(ies) about a horizontal level(s) with an underlying horizontal reservoir and a plurality of vertical runners from the reservoir to the cavity(ies).

Mold Design Principles

The object of our mold design is to deliver a steady, generally quiescent flow of molten metal to all of the thin wall portions of the mold cavity at substantially the same time and substantially the same temperature.

When an iron-based alloy is being cast, the vertical pouring sprue extends to a height at least 150 mm greater than the height of the tallest vertical runner rising from the reservoir. In the case of other metals, this length is inversely proportional to the ratio of the density of the metal to that of iron. In each case, the height is measured from the level of the reservoir. The sprue must also extend to a height above the highest portion of the casting cavity. The casting cavity is vented at its highest portions so that air can be expelled from the cavity as the cast metal flows upwardly from the reservoir through the vertical runners into the cavity. Since the sprue extends higher than any other portion of the flow path of the cast metal, it provides a metallostatic head of metal which keeps pressure on the mold cavity and assures that it is full of molten metal as the casting solidifies. In fact, the metal in the sprue is intended to be the last metal to solidify in the mold system. Once air has been expelled from the cavity vent, if the vents are suitably sized, the rising metal will quickly freeze there, indicating that the cavity has been filled with molten metal and plugging the vent from further expulsion of metal.

It is obvious by now that the horizontal reservoir is a critical part of our mold design. An important feature of the reservoir is that it is horizontal and that it completely fills with metal that mixes in the reservoir and attains substantially a uniform temperature there before the flow rises from the reservoir through the vertical runners. The reservoir is to be designed in the mold so as to underlie either the entire casting cavity as was illustrated in the FIG. 1/FIG. 2 embodiment of our invention or at least those portions of the mold cavity to which metal must be supplied to form the thin wall portions of the cavity. The FIG. 3 embodiment of our invention illustrates the channel-type reservoir underlying the casting cavity at the peripheral portions of the cavity where we introduce molten metal through our vertical runners into each of the several thin wall portions of the cavity. We prefer that the reservoir be designed with a volume-to-surface area ratio that is conductive to the mixing of the incoming cast metal but minimizes the heat loss. In general, our experience has been that the volume of the reservoir divided by its geometrical surface area should preferably be greater than or equal to about 5 millimeters. The configuration of the reservoir should accommodate mixing of the flowing cast metal so as to deliver molten metal of a uniform temperature to the casting cavity. The goal is to design the flow passages from the downsprue to the reservoir so that the reservoir is filled with a constant temperature molten metal before any metal flows upward toward the mold cavity.

The cross-sectional area of the reservoir should be greater than the cross-sectional area of the downsprue.

We attempt to position the cavity of the thin wall body to be cast in the mold so that the vertical runners deliver metal into the cavity at as close to the same height as possible. This enables the molten metal to rise in the vertical runners and enter all portions of the mold cavity at substantially the same time and substantially the same temperature. The mold illustrated in the FIG. 1/FIG. 2 embodiment, of course, has vertical runners of equal height. The mold depicted by the cast metal in the FIG. 3 embodiment has some variation in the height of the vertical runners. We prefer that the variation in the height of the vertical runners above the reservoir to the point where the metal enters the casting cavity be less than or equal to about 63 millimeters. Again, the purpose of this feature is to minimize temperature gradients in the cast metal entering the mold cavity.

We seek to position the vertical runners so that they introduce molten metal into the thin wall portions of the cavity either at the side (as was done in the FIG. 1/FIG. 2 and FIG. 3 embodiments) or at the bottom of the thin sections. When we pour metal for castings that are stacked in vertical planes, we prefer that the respective cavities be directly above each other, that they follow the runner placement rules that we have defined, and that the same vertical runners sequentially fill each casting from the lowermost to the uppermost. Of course, the height of the casting pouring sprue must be increased so that it provides sufficient metallostatic head to fill the uppermost cavity.

Our mold design is especially adapted for the casting of ferrous-based alloys such as nodular iron, stainless steels and alloy steels. In general, we prefer that the molten metal be at least 90° C. above its first solidification point. This amount of superheat is not unusual for the casting of such metal alloys.

The maximum spacing of the vertical runners to the thin wall portions of the mold cavity is influenced by the amount of superheat of the cast alloy and its metallostatic head. We have developed the following generalized empirical relationships for the minimum spacing of the vertical runners in millimeters for the following ferrous alloys.

1. We have cast, for example, high silicon, molybdenum, nodular iron with superheats varying from 235° C. to 300° C. and with a sprue head height of 230 to 495 millimeters above the height of the highest vertical runner. In general, we have found that the maximum allowable spacing of vertical runners for a wall thickness of one millimeter was about 150 mm spacing and for a wall thickness of two millimeters was 300 mm spacing. Assuming a further linear relationship, we would specify a maximum vertical runner spacing of about 450 mm for a three millimeter wall thickness casting.
2. We have prepared castings with a nonhardenable stainless steel composition at superheats of 175° C. to 250° C. and head heights of 150 to 460 mm. In general, our experience was that a vertical runner spacing should not exceed about 50 mm for a wall thickness of one millimeter, a spacing of about 175 mm for a casting wall thickness of two millimeters, and a 300 mm runner spacing for a casting thickness of three millimeters.
3. For a representative hardenable alloy steel (SAE 4340), we prepared castings with superheat values ranging from 110° C. to 225° C. and head heights of 215 to 585 mm. We found that, in general, a maximum suitable runner spacing of about 50 mm was appropriate for a one millimeter wall thickness, a maximum runner spacing of 150 mm for a two millimeter casting wall thickness, and a maximum spacing of about 300 mm for a three millimeter wall thickness.

In summary, our mold design is based on a goal of causing substantially equal temperature metal to flow at the same time into several different thin wall portions of the casting cavity so as to fill it with a quiescent flow of metal from several points of entry and to thereby completely fill the cavity before any solidification of metal in the cavity occurs.

Thus, while our invention has been described in terms of a specific embodiment thereof, it will be appreciated that other forms could readily be adapted by those skilled in the art. Accordingly, the scope of our invention is to be considered limited only by the scope of the following claims.

The embodiments of the invention in which an exclusive property or privilege is claimed are defined as follows:

1. A mold for the gravity pouring of molten metal to form a cast body comprising thin wall portions as small as one to three millimeters in thickness, said mold being formed of resin-bonded sand and comprising:

a mold cavity defining said cast body and oriented with the cavity portions defining said thin wall portions positioned about a common horizontal level, a horizontally disposed reservoir below said mold cavity and underlying at least said thin wall defining cavity portions, said reservoir being shaped with a volume-to-geometric surface area ratio of at least five millimeters, a plurality of runners rising vertically from said reservoir and connecting to said thin wall cavity defining portions, the difference in length between the longest and shortest of said runners being no more than about 63 mm, said runners being located in said mold so as to deliver molten metal substantially simultaneously to all said thin wall defining cavity portions, and a vertical sprue with a cast metal inlet above the level of said cavity and a distance above the height of the tallest of said runners that provides at such height a minimum metallostatic head equivalent to 150 mm of molten iron, said sprue having an outlet in fluid flow communication with said reservoir, the cross-sectional area of said sprue being no greater than the cross section of flow of cast metal into said reservoir, said vertical sprue, reservoir and vertical runners cooperating with each other and with the thin wall portions of the mold cavity such that poured metal enters and fills said reservoir with metal before rising simultaneously in each of said vertical runners so as to feed molten metal to the thin wall portions of the cavity from a plurality of sources spaced within determined effective cavity filling distances of each other so as to completely fill said cavity before solidification occurs.

2. A mold for the gravity pouring of molten metal to form a cast body comprising thin wall portions as small as one to three millimeters in thickness, said mold being formed of resin-bonded sand and comprising:

a mold cavity defining said cast body and oriented with the cavity portions defining said thin wall portions positioned about a common horizontal level, a horizontally disposed reservoir below said mold cavity and underlying at least said thin wall defining cavity portions, said reservoir being shaped with a volume-to-geometric surface area ratio of at least five millimeters, a plurality of runners rising vertically from said reservoir and connecting to said thin wall cavity defining portions, the difference in length between the longest and shortest of said runners being no more than about 63 mm, said runners being located in said mold so as to deliver molten metal substantially simultaneously to all said thin wall defining cavity portions, and a vertical sprue with a cast metal inlet above the level of said cavity and a distance above the height of the tallest of said runners that provides at such height a minimum metallostatic head equivalent to 150 mm of molten iron, said sprue having an outlet in fluid flow communication with said reservoir, the cross-sectional area of said sprue being no greater than the cross section of flow of cast metal into said reservoir, said vertical sprue, reservoir and vertical runners cooperating with each other and with the thin wall portions of the mold cavity such that poured metal enters and fills said reservoir with substantially uniform temperature metal before rising simultaneously in each of said vertical runners so as to feed molten metal to the thin wall portions of the cavity from a plurality of sources spaced within determined effective cavity filling distances of each other so as to completely fill said cavity before solidification occurs.

3. A mold for the gravity pouring of molten ferrous metal alloy to form a cast body comprising thin wall portions as small as one to three millimeters in thickness, said mold being formed of resin-bonded sand and comprising:

a mold cavity defining said cast body and oriented with the cavity portions defining said thin wall portions positioned about a common horizontal level, a horizontally disposed reservoir below said mold cavity and underlying at least said thin wall defining cavity portions, said reservoir being shaped with a volume-to-geometric surface area ratio of at least five millimeters, a plurality of runners rising vertically from said reservoir and connecting to said thin wall cavity defining portions, the difference in length between the longest and shortest of said runners being no more than about 63 mm, said runners being located in said mold so as to deliver molten metal substantially simultaneously to all said thin wall defining cavity portions, and a vertical sprue with a cast metal inlet above the level of said cavity and at least 150 mm above the height of the tallest of said runners, said sprue having an outlet in fluid flow communication with said reservoir, the cross-sectional area of said sprue being no greater than the cross section of flow of cast metal into said reservoir, said vertical sprue, reservoir and vertical runners cooperating with each other and with the thin wall portions of the mold cavity such that poured metal enters and fills said reservoir with substantially uniform temperature metal before rising simultaneously in each of said vertical runners so as to feed molten metal to the thin wall portions of the cavity from a plurality of sources spaced within determined effective cavity filling distances of each other so as to completely fill said cavity before solidification occurs.

* * * * *